US005632303A

United States Patent [19]

Almasy et al.

[11] Patent Number: 5,632,303

[45] Date of Patent: May 27, 1997

[54] WALL WATER HYDRANT HAVING BACKFLOW AND BACK SIPHONAGE PREVENTOR

[75] Inventors: Lawrence Almasy; James F. Shuler; Robert J. Vandepas; William L. Carlson, all of Colorado Springs, Colo.

[73] Assignee: WCM Industries, Inc., Colorado Springs, Colo.

[21] Appl. No.: 648,530

[22] Filed: May 15, 1996

Related U.S. Application Data

[63] Continuation of Ser. No. 88,889, Jul. 8, 1993, abandoned.

[51] Int. Cl.[6] ..... F16K 15/18

[52] U.S. Cl. ..... 137/360; 137/218; 137/614.2

[58] Field of Search ..... 137/218, 360, 137/614.2, 854

[56] References Cited

U.S. PATENT DOCUMENTS

| | | |
|---|---|---|
| 4,182,356 | 1/1980 | Woodford, Sr. . |
| 4,209,033 | 6/1980 | Hirsch et al. . |
| 4,286,616 | 9/1981 | Botnick . |
| 4,619,287 | 10/1986 | Hama et al. . |
| 4,821,762 | 4/1989 | Breneman . |

*Primary Examiner*—Gerald A. Michalsky
*Attorney, Agent, or Firm*—Zarley, McKee, Thomte, Voorhees, & Sease

[57] ABSTRACT

A wall mounted water hydrant has an elongated hollow housing with water inlet and outlet ends, and a center axis; an inlet valve in the housing adjacent to the inlet end, including a valve seat and a valve body; a water outlet port in the housing adjacent to its outlet end; a valve operating rod in the housing with its an inner end secured to the valve body and extending along the center axis to the outlet end of said housing, terminating in an outer end; a handle attached to the rod outer end, which when rotated in one direction closes the valve body against the valve seat, and in the other opposite direction moves the valve body away from the seat, thus allowing pressurized water from the inlet to flow downstream through the housing and outlet port; and a backflow preventor secured to the valve downstream from its seat. The elastomeric backflow preventor has a bell shape comprising a cylindrical body smaller than the interior of the housing and thin flexible side walls extending from the body outwardly and downstream to end in a lip portion which normally engages the interior walls of the housing. The construction of the preventor permits it to deflect toward the axis of the housing when water is flowing in a downstream direction and to engage the interior surface of the housing if backpressure urges water to flow in an upstream direction, thus sealing the valve means against backflow.

1 Claim, 2 Drawing Sheets

2
2
10
12
14
16
18
20
22
24
25
26
28
30
32
34
35
36
38
39
40
42
44
45
46
48
50
51
52
54

WALL WATER HYDRANT HAVING BACKFLOW AND BACK SIPHONAGE PREVENTOR

This is a continuation of application Ser. No. 08/088,889 filed on Jul. 8, 1993, now abandoned.

BACKGROUND OF THE INVENTION

This invention relates to the protection of water hydrants from undesirable backpressure backflow, and back siphonage backflow. Hoses and equipment are frequently connected to freezeless outdoor water hydrants to accomplish various tasks. Significant backpressure or siphonage can be encountered during some tasks, particularly if a break occurs in the primary water line.

Freezeless wall faucets or hydrants are known in the art. Generally, these devices include a hollow housing having an interior inlet end connected to a source of pressurized water and an exterior outlet. A valve is included within the housing and is connected by means of a rod to a manually operable handle outside the housing. Rotation of the handle causes the valve to open and close. Freezeless faucets are normally wall-mounted on the exterior of a building with the valve extending inwardly with respect to the building to a point where the valve is protected from freezing by warmth from the interior of the building. The handle and outlet are located on the exterior of the building.

A freezeless water faucet with a removable valve cartridge is shown in U.S. Pat. No. 4,821,762 to Breneman. The removable valve cartridge is supported on an operating rod which extends centrally within a bore in the elongated housing of the faucet. Various methods have been tried in conjunction with such faucets to control the flow and backpressure within to prevent damage and contamination. Unfortunately, face sealing backflow preventors like the one shown by Brememan adversely affect the output flow characteristics of the faucet and require a separate spring and seat for proper sealing. In freezeless faucets, it is difficult to accommodate backpressure preventors within the housing without interfering with the operation of the centrally located valve cartridge.

SUMMARY OF THE INVENTION

There is a need for an improved means of preventing contamination of the water source by backflow or siphoning in a freezeless hydrant. Therefore a principal object of this invention is to provide an improved backpressure and back siphonage preventor for a freezeless hydrant.

A further object of the present invention is to provide a backflow and back siphonage preventor which is mounted to the operating rod and seals against the wall of the hollow housing when the fluid forces are greater downstream than upstream of the preventor.

A further object of the present invention is to provide a backflow and back siphonage preventor which allows water to be delivered from the source so long as the valve is open and the fluid forces are greater upstream than downstream of the preventor.

A further object of the present invention is to provide a backflow and back siphonage preventor which is durable, readily serviceable, inexpensive to manufacture, and capable of self-flushing for removal of debris during operation.

The wall mounted water hydrant of this invention has an elongated hollow housing with water inlet and outlet ends, and a center axis; a water inlet valve means in the housing adjacent to the inlet end, including a valve seat and a valve body; a water outlet port in the housing adjacent to its outlet end; a valve operating rod in the housing with its an inner end secured to the valve body and an outer end extending along the center axis to the outlet end of said housing where a handle is attached thereto for rotating the operating rod. Rotation of the rod in one direction will advance the valve body on to the valve seat, and rotation of the rod in an opposite direction will retract the valve body away from the seat, thus providing a gap therebetween through which pressurized water connected to the inlet can flow in a downstream direction through the housing and exit through the outlet port. A backflow preventor element is secured to the valve means downstream from the valve seat. The term backflow preventor as used herein will refer to both the concepts of back siphonage backflow as well as backpressure backflow.

The backflow preventor has a cylindrical body element with a smaller diameter than the interior of the housing and an outward cylindrical periphery with a flexible flange normally extending outwardly therefrom to engage the interior surface of the housing. The flexible flange is constructed to permit it to deflect toward the axis of the housing when water is flowing in a downstream direction and to deflect outwardly from the housing axis to engage the interior surface of the housing if backpressure on back siphonage urges water to flow in an upstream direction. Thus the housing and valve means are selectively sealed against backflow occurring from all causes. Part or all of the backflow preventor may be made from elastomeric material for improved deflection and sealing characteristics. The backflow preventor has a hollow or bell shape with triangular shaped flange that can bear against the interior surface of the housing to create a seal under backflow conditions.

DESCRIPTION OF THE PREFERRED EMBODIMENT

Figures 1, 2, 3:
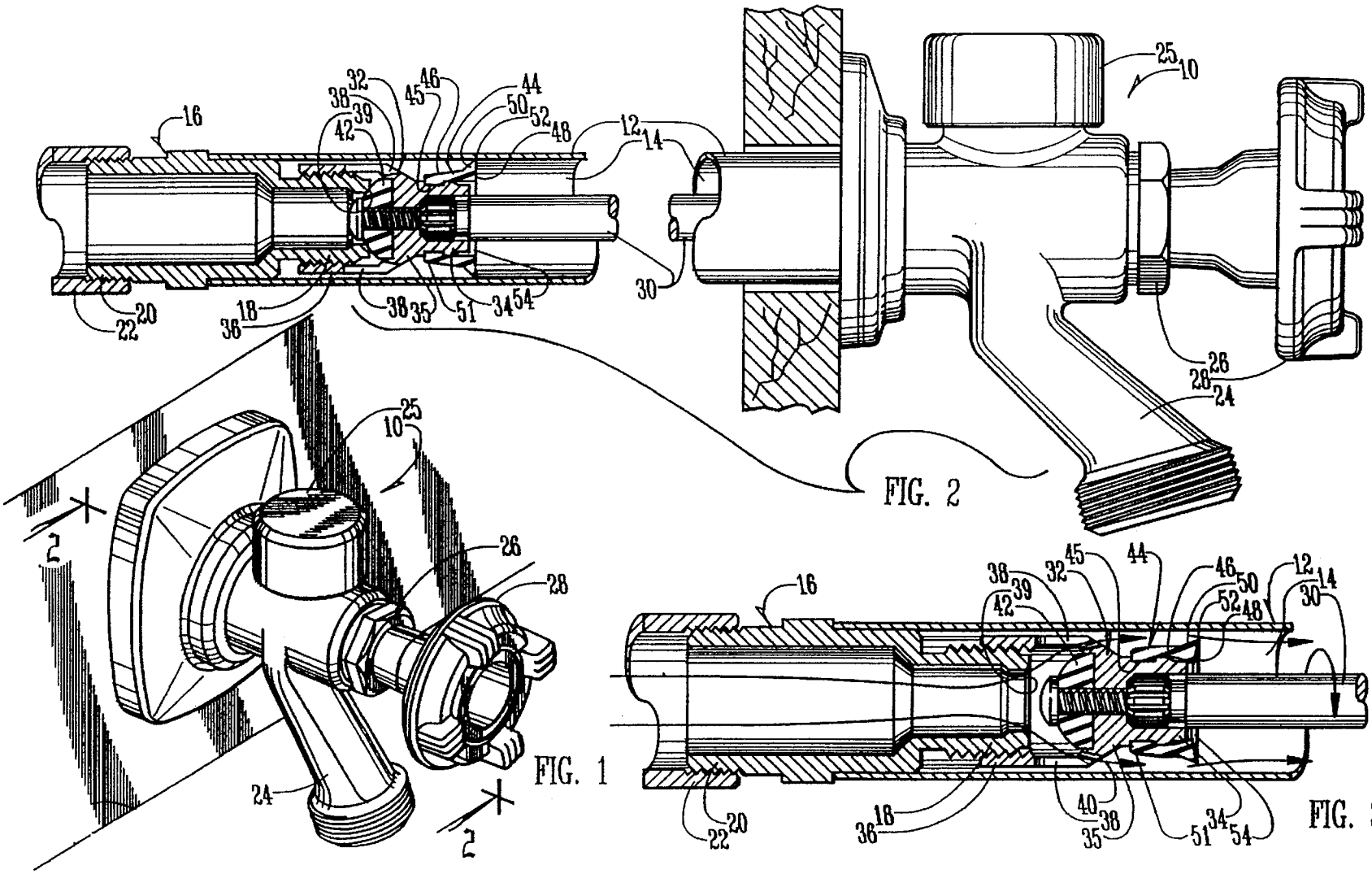
FIG. 1 is a perspective view of the water hydrant of the present invention mounted to the outer wall of a house.
FIG. 2 is a sectional view taken along line 2—2 of FIG. 1 showing the water hydrant in its closed position.
FIG. 3 is an enlarged sectional view of the hydrant in its open position.

Referring to FIG. 1, the numeral 10 generally designates the wall-mounted water hydrant of the present invention. As shown in FIG. 2, hydrant 10 includes a hollow elongated housing 12 having a central elongated bore 14. One end of bore 14 is in sealed engagement with the middle portion of a hollow brass connector 16. The upper and lower ends 18, 20 of connector 16 have male pipe threads as showing in FIG. 2. The lower end 20 of connector 16 is threaded into inlet pipe 22, which is connected to a conventional source of pressurized water. The other end of bore 14 is connected to a water outlet port 24 and a vacuum breaker 25, which the particulars of are not crucial to the present invention.

A movable valve assembly 26, located centrally and removably within bore 14, is in conventional sealed engagement with the end of the bore 14 that is associated with the outlet port 24. Movable valve assembly 26 can be retracted from a close position shown in FIG. 2 to the open position shown in FIG. 3 by a manual means for rotating, such as a handle 28, which is connected to one end of an elongated operating rod 30. Referring again to FIG. 2, the other end of operating rod 28 is connected to the upper end of a valve casing 32.

Figure 4:
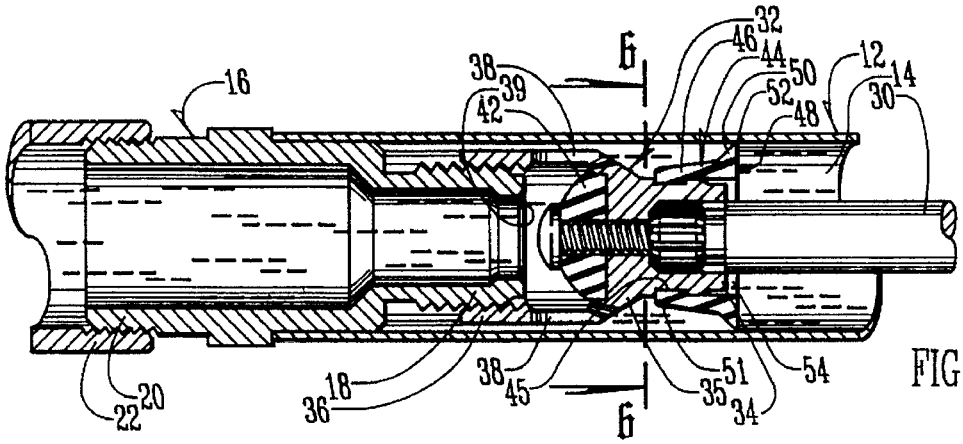
FIG. 4 is a view similar to FIG. 3, but showing the valve assembly in its open, but backflow preventing position.
Figure 5:
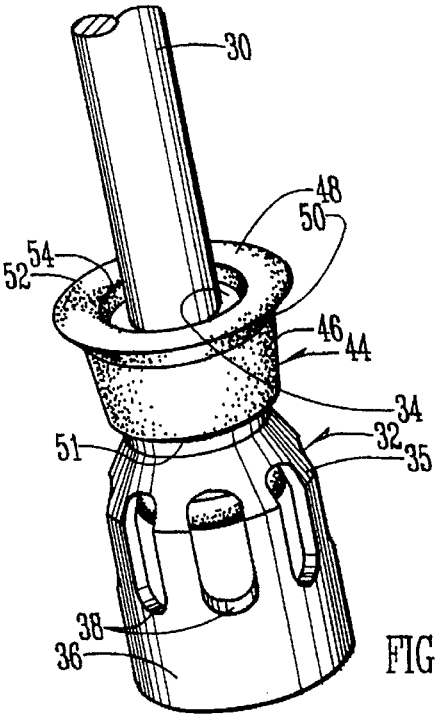
FIG. 5 is a perspective view of the valve assembly with the backflow preventor of this invention installed thereon.
Figure 6:
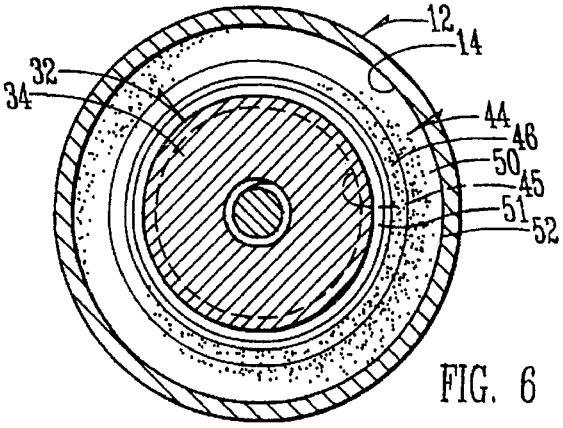
FIG. 6 is a sectional view taken along line 6—6 of FIG. 4 showing the backflow preventor on the valve assembly.

Valve casing 32 has upper and lower portions 34, 36. The lower portion 36 is larger in diameter than the upper portion 34 and there is an intermediate necked portion 35 between the two. As best seen in FIG. 5, the lower portion 36 of valve casing 32 is hollow with a plurality of apertures 38 extending through the lower portion 36 and into the necked portion 35. Apertures 38 allow water to flow from the inlet through the valve assembly 26 to the outlet port 24 under conditions shown in FIG. 3. FIG. 2 shows that lower portion 36 of valve casing 32 and the upper end 18 of connector 16 are joined in conventional sealed engagement by pipe threads. When its threads are fully engaged, the upper end 18 of connector 16 extends adjacent to, but does not completely cover the apertures 38 in valve casing 32. As shown in FIG. 4 and FIG. 6, the inside of the necked portion 35 of the valve casing 32 and the upper end of connector 16 form annular seats 39 around a valve opening 40.

Valve closure element or body 42 is fastened by conventional means to the end of operating rod 30 opposite handle 26. Valve body 42 is smaller in diameter than the interior of the lower portion 36 of valve casing 32, but greater in diameter than the interior of the upper end 18 of connector 16. To assemble movable valve assembly 26, operating rod 28 is first attached to the upper portion 34 of valve casing 32. Then valve body 42 put inside the lower portion 36 of the valve casing 32 and then fastened to the end of operating rod 30. The resulting movable valve assembly 26, shown in FIG. 2 and FIG. 5, can be retracted or advanced axially within bore 14 by rotating handle 28. When handle 28 is rotated in one direction, valve body 42 eventually comes into contact with the end of connector 16 as shown in FIG. 2. In this position, valve body 42 is seated on seats 39 and the flow of fluid from inlet pipe 22 to the outlet port 24 is blocked.

FIG. 6 shows valve assembly 26 after it has been rotated in the opposite direction. Valve body 42 has been withdrawn from seats 39 to create a valve opening 40. Valve body 42, acts in conjunction with connector 16 to form an inlet valve means for operating the hydrant. Fluid is thereby permitted to flow through inlet pipe 22, connector 16, valve opening 40, apertures 38 around operating rod 30 and to outlet port 24.

FIG. 4 shows the effects of backpressure on the hydrants of this invention. To prevent backflow, which can be caused by excessive water pressure at outlet port 24, a backflow preventor 44 is installed into groove 45 in the upper portion 34 of valve casing 32 downstream of the valve seats 39.

Figure 7B:
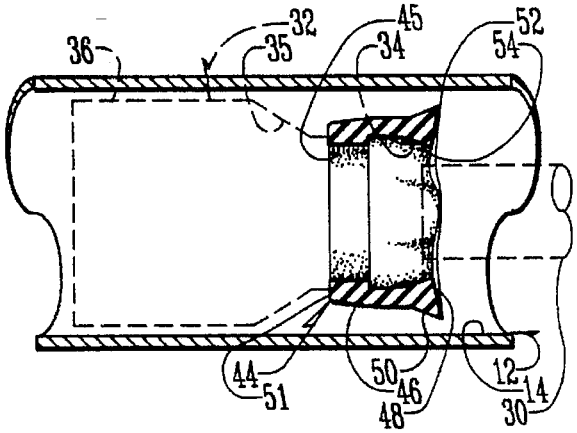
FIG. 7B is an enlarged section view of the backflow preventor, in its crimped state, deflecting toward the axis of the housing to allow inlet water to flow over the preventor.
Figure 7A:
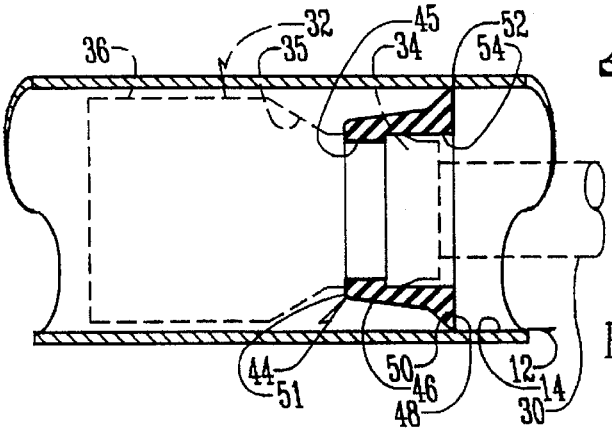
FIG. 7A is an enlarged section view of the backflow preventors, in its expanded state, sealing against the interior of the housing.

Backflow preventor 44 is preferably made of a resilient, elastomeric material, such as rubber. FIG. 7A shows that preventor 44 is shaped like a hollow bell. A cylindrical base portion 46 has an outer diameter less than housing bore 14. The inner diameter of base portion 46 is large enough to be stretched over the upper portion 34 of valve casing 32 on operating rod 30 during installation, but small enough to seal effectively against water pressure when seated in groove 45. Thus, preventor 44 can be easily replaced if it becomes worn or damaged.

Thin, flexible inner and outer side walls 48, 51 extend downstream and diagonally outward from base portion 46 toward outlet port 24 to terminate in a cylindrical lip portion 52. In the free state of preventor 44, lip 52 normally engages housing bore 14 to seal against flow. Walls 48 and 51 constitute the opening of the bell shape and they encompass a hollow interior 54, which accommodates the valve casing 32 on rod 30 and the deflection or crimping of walls 48 and 51 when necessary.

Walls 48 and 51 and interior 54 present areas against which water pressure can act, forcing preventor 44 to crimp or expand in response to flow or backflow, respectively. Outer wall 51 presents an angled surface against which, under normal conditions, the pressure of inlet flow will act to force, deflect, or crimp preventor 44 toward the central axis of bore 14. Lip 52 is forced out of sealed engagement with the walls of bore t4 and water from the inlet is permitted to flow over preventor 44 to outlet port 24. This normally flowing condition of hydrant 10 is shown in FIGS. 3 and 7B. On the other hand, when downstream pressure urges backflow, inner wall 48 and hollow interior 54 react to the backpressure by expanding outwardly from the central axis of bore 14. Lip 52 is forced back into sealed engagement with the walls of bore 14. Whenever the effects of downstream pressure are greater on preventor 44 than the forces from inlet flow, it will automatically seal off bore 14 to prevent backflow as shown in FIGS. 4 and 7A.

FIGS. 2–4 show that, in the preferred embodiment, the flange size is selected to achieve a slip fit with bore 14. Therefore, valve assembly 26 can be easily installed, rotated, and removed. No backflow may leak past preventor 44 because it seals against the walls of housing bore 14 in its naturally expanded state.

FIG. 3 shows inlet pressure deflecting the upstream-directed surfaces of flange 50 away from the wall of bore 14 and toward the central axis of the same. This deflection or crimping allows water to flow from inlet 22, around backflow preventor 44, to outlet port 24. Therefore, hydrant 10 supplies water in the usual manner with minimal obstruction. Preventor 44 is crimped by inlet pressure to lay just above the upper portion 34 valve casing 32.

FIG. 4 shows how the backflow preventor 44 works when the downstream pressure (at outlet port 24) is greater than inlet pressure. The stronger pressure from flow in an upstream direction forces the flange 50 outward into sealed engagement with the wall of bore 14. This prevents backflow from the outlet 24 to the inlet 22. Contamination is avoided, whether backpressure backflow or back siphonage occurs. Further, this invention enhances the conventional function of vacuum breaker 25, and creates an effective anti-siphonage phenomenon. An unexpected result is that this invention also creates an effective backpressure backflow phenomenon. In addition, the ability of the backflow preventor to collapse during normal flow as shown in FIG. 7B permits the hydrant to be automatically flushed to free itself of any debris in the water, and therefore is essentially free of fouling.

Thus, it can be seen that the device accomplishes at least the stated objectives.

I claim:

1. A wall mounted water hydrant, comprising:

an elongated hollow housing having water inlet and outlet ends, and a center axis;

a water inlet valve in said housing adjacent said inlet end, and comprising a valve seat and a valve closure element;

a water outlet port in said housing adjacent said outlet end;

a valve operating rod in said housing having an inner end secured to said valve closure element, and extending along the center axis to the outlet end of said housing, and terminating in an outer end;

a manual means for rotating said outer end of said actuating rod whereby rotation of said rod in one direction will close said valve closure element against said valve seat, and rotation of said rod in an opposite direction will move said valve closure element away from said valve seat, thus providing a valve means through which pressurized water connected to the inlet end of said housing will flow in a downstream direction through said valve means and said housing and outwardly through said outlet port;

a backflow preventor having a base portion surrounding said operating rod;

said backflow preventor having the shape of a hollow bell with flexible side walls extending diagonally outwardly from said base portion and encompassing a hollow interior, and terminating in a cylindrical lip portion surrounding an open end;

said lip portion being cylindrical in shape and normally engaging the inner diameter of said housing;

said lip portion having a first outer surface extending diagonally outwardly from said sidewalls and intersecting a vertical flat planar portion which is in a plane transverse to said center axis to create a pointed sealing edge normally in engagement with the inner diameter of said housing, said lip comprising a triangular cross sectional shape, said lip portion having a size and shape to permit it to deflect toward the axis of said housing when water is flowing in a downstream direction through said housing, and to engage the inner diameter of said housing if backpressure urges water to flow in an upstream direction through said housing, thus sealing said housing and said valve means, against upstream flow of water under such backpressure conditions.

* * * * *